US006408551B1

(12) United States Patent
Pettersson

(10) Patent No.: US 6,408,551 B1
(45) Date of Patent: Jun. 25, 2002

(54) BUCKET

(76) Inventor: Stig Pettersson, Skolgatan 3 A, S-825 31, Iggesund (SE)

( * ) Notice: Subject to any disclaimer, the term of this patent is extended or adjusted under 35 U.S.C. 154(b) by 0 days.

(21) Appl. No.: 09/581,815

(22) PCT Filed: Dec. 19, 1997

(86) PCT No.: PCT/SE97/02205

§ 371 (c)(1),
(2), (4) Date: Jun. 29, 2000

(87) PCT Pub. No.: WO99/32732

PCT Pub. Date: Jul. 1, 1999

(51) Int. Cl.[7] ..... E02F 3/96

(52) U.S. Cl. ..... 37/409; 37/444; 37/903; 414/722

(58) Field of Search ..... 37/403, 406, 408, 37/409, 401, 901, 903, 904; 414/722, 724, 726, 729

(56) References Cited

U.S. PATENT DOCUMENTS

| | | | | |
|---|---|---|---|---|
| 3,003,165 | A | * | 10/1961 | Lutjens |
| 3,341,041 | A | * | 9/1967 | Salna |
| 3,375,597 | A | * | 4/1968 | Michael |
| 3,630,396 | A | * | 12/1971 | Womack |
| 3,743,358 | A | * | 7/1973 | Guest |
| 3,765,490 | A | * | 10/1973 | Logue |
| 3,904,052 | A | * | 9/1975 | Nordstrom |
| 4,157,956 | A | * | 6/1979 | Robinson |
| 4,420,189 | A | * | 12/1983 | Von Ruden |
| 5,241,764 | A | * | 9/1993 | Modig |
| 5,493,796 | A | * | 2/1996 | Ballew et al. |
| 5,501,024 | A | * | 3/1996 | Bergeron |
| 5,581,916 | A | * | 12/1996 | Hirose et al. |
| 5,678,332 | A | * | 10/1997 | Hawkins |
| 5,940,996 | A | * | 8/1999 | Cummings |

FOREIGN PATENT DOCUMENTS

| | | | |
|---|---|---|---|
| EP | 0657589 | A1 | 6/1995 |
| SE | 2083110 | A | 3/1982 |
| SE | 464094 | B | 3/1991 |
| SE | 9300729 | A | 9/1994 |
| SE | 9602798 | A | 1/1998 |
| WO | 9634153 | A1 | 10/1996 |

OTHER PUBLICATIONS

Willma–Skopan "Torkraft AB", 1995.

* cited by examiner

*Primary Examiner*—Victor Batson
(74) *Attorney, Agent, or Firm*—Nixon & Vanderhye

(57) ABSTRACT

Bucket (1) intended to be carried by means of an arm or the like for manoeuvring and comprising a bottom and back part and opposing side parts (4), which parts together from a load space (5) with an opening (6) having an edge part (8) connected to the bottom and edge part and running sideways in the bucket. The bucket is especially characterized in, that said bottom and back part (3) comprises an internal sorting part (9) through, which among other things liquid and comparatively finely dispersed goods, e.g. sand and earth, may pass. as well as an external sealing part (10), which is swingable towards and from the sorting part between a first position, in which the sorting part is substantially exposed, and a second position, in which the sealing part substantially connects to the sorting part.

14 Claims, 4 Drawing Sheets

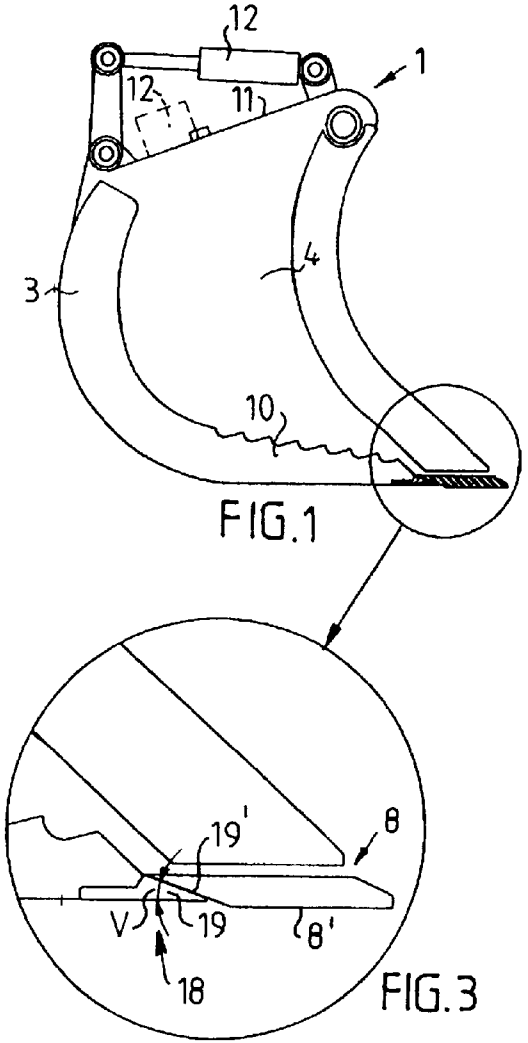
FIG. 1
FIG. 3
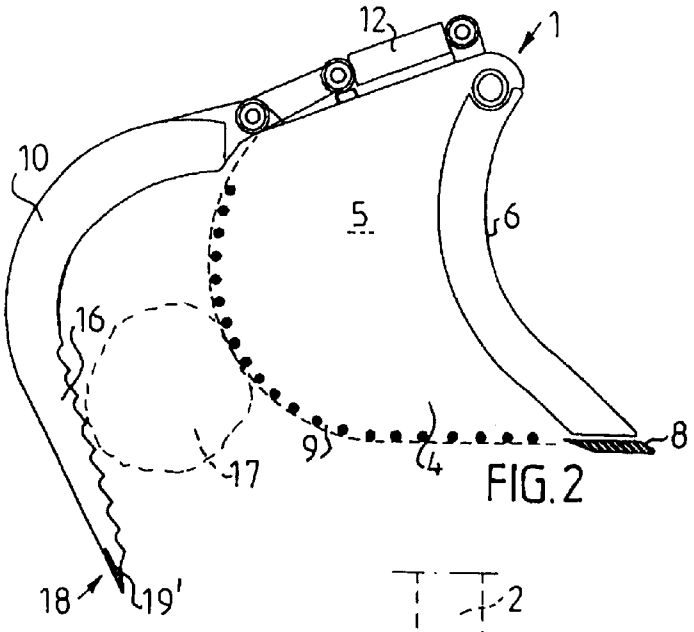
FIG. 2
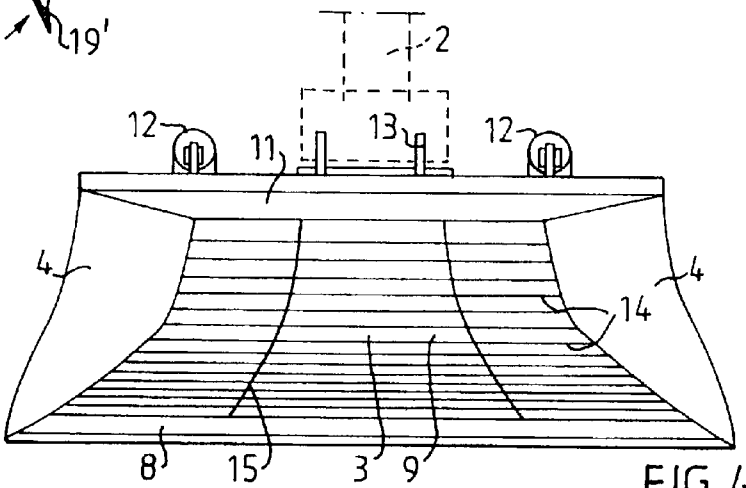
FIG. 4

BUCKET

The present invention relates to a bucket intended to be carried by an arm or the corresponding and comprising a bottom and back part and opposing side parts, which parts are arranged to, together, form a load space having an opening with an edge part connected to the bottom part of the bottom and back part and running sideways in the bucket.

Buckets of substantially this kind are previously known and are used for example for excavating. Buckets of this kind are comparatively limited as far as area of use is concerned.

The present invention relates to a bucket, which offers a substantially broader area of use.

Thus, the invention refers to a bucket according to the introductory part of the attached claim 1. The bucket is especially characterized in what is specified in the characterizing part of said claim.

Figure 6:
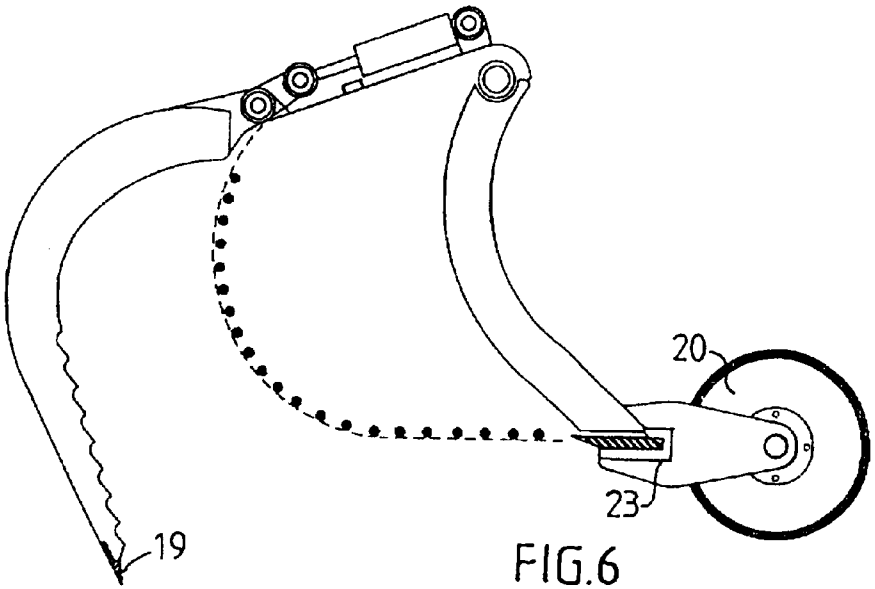
Figure 5:
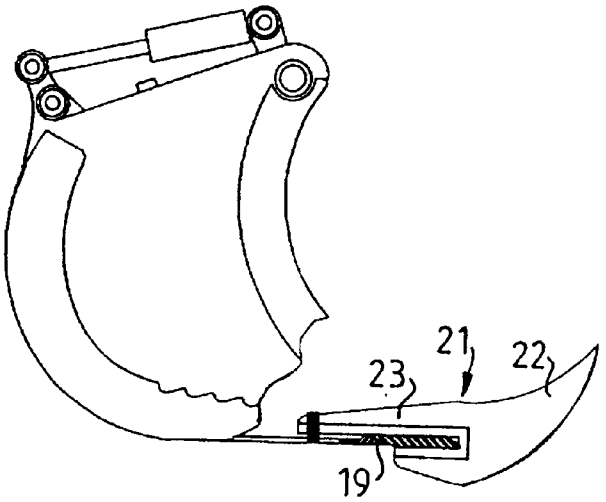
Figure 8:
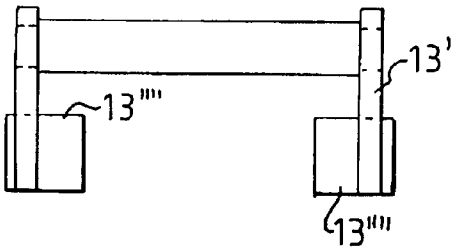
Figure 7:
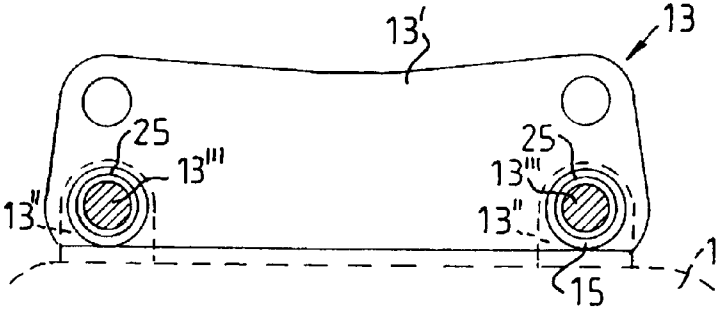
Figure 9:
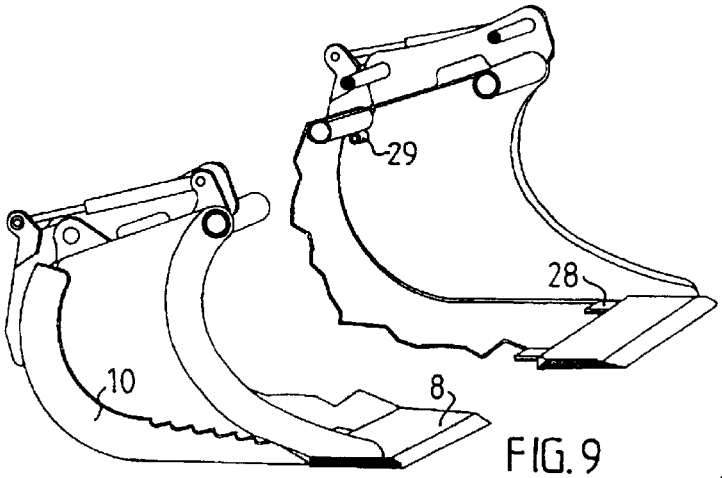
Figure 10:
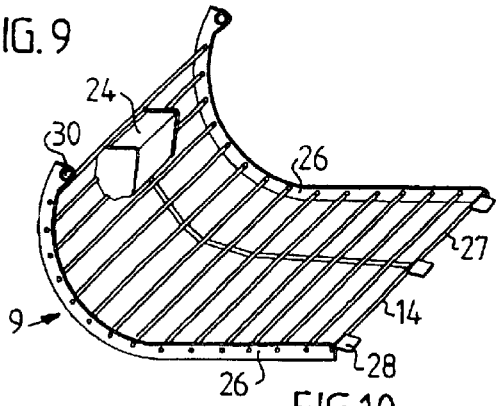
Figure 11:
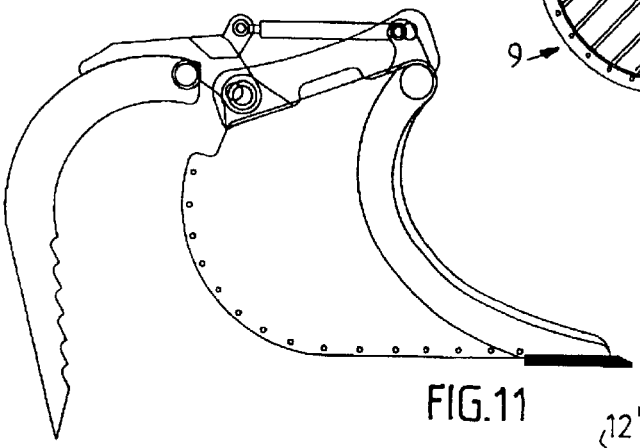
Figure 16:
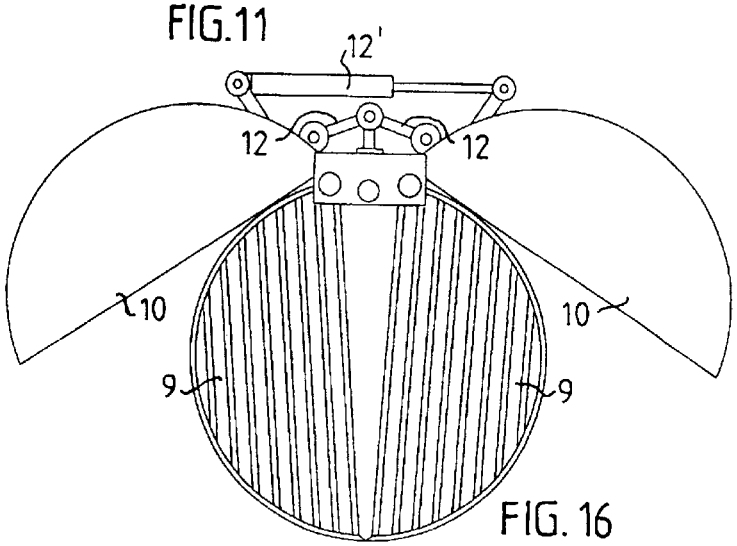
Figure 12:
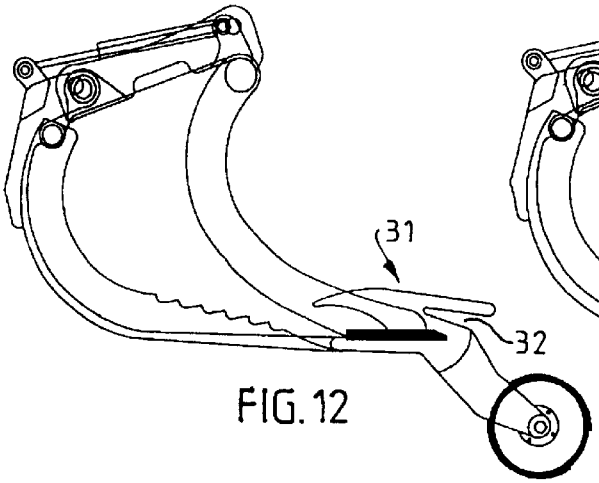
Figure 13:
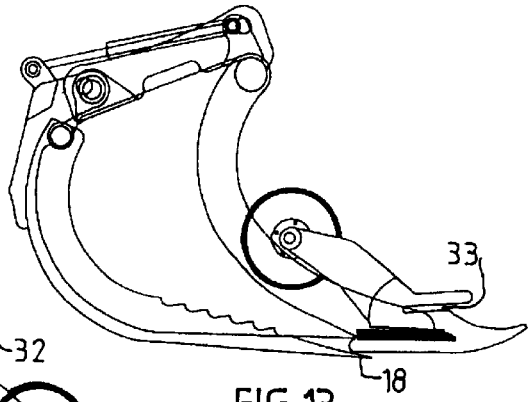
Figure 14:
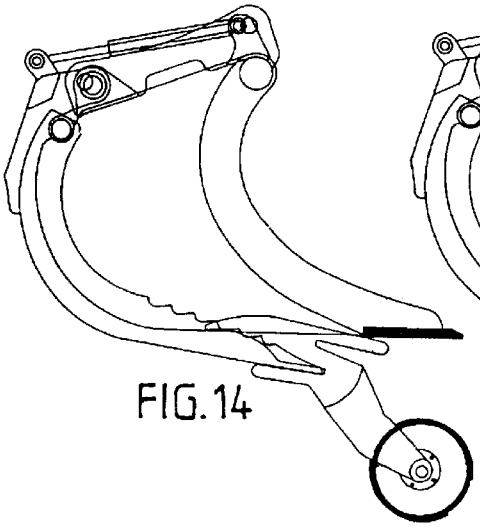
Figure 15:
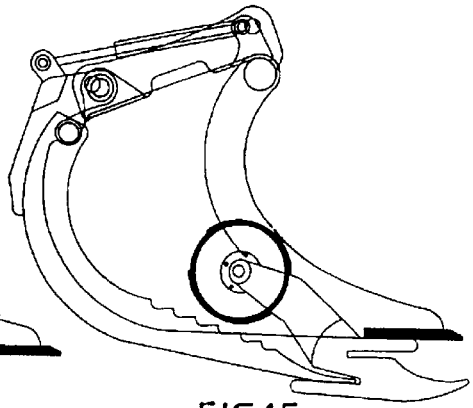

Below, the invention is described in association with exemplifying embodiments and attached drawings, in which FIG. 1 schematically shows a first embodiment of a bucket according to the invention in a closed position and in a side view, FIG. 2 shows the bucket according to FIG. 1 in an open position, FIG. 3 shows a detail of the bucket according to FIG. 1 regarding among other things fastening of tools, FIG. 4 schematically shows a bucket according to FIG. 1 seen from the right in FIG. 1, FIG. 5 schematically shows a bucket according to FIG. 1 with a tool in the form of a ripper tooth arrangement, FIG. 6 schematically shows a bucket according to FIG. 1 with a tool in the form of a cutting device for asphalt, FIG. 7 more in detail shows an attachment seen in the width direction of the bucket, FIG. 8 shows the fastening arrangement according to FIG. 7 seen from the right in FIG. 7 and without devibrationally arranged axles, FIG. 9 schematically shows a second embodiment of a bucket according to the invention shown in a perspective view towards its opening and sectioned substantially perpenticular to its width direction and without sorting part, FIG. 10 shows a sorting part intended to be arranged, inside the bucket according to FIG. 9, FIG. 11 schematically shows a side view of a bucket according to FIG. 9 in an open position, sorting position, FIG. 12 schematically shows a side view of a bucket according to FIG. 9 with a combined ripper and asphalt cutting tool in an asphalt cutting position, FIG. 13 shows an arrangement according to FIG. 12 with the tool in ripping position, FIGS. 14 and 15 show the arrangement according to FIG. 12 and 13 respectively, where, however, the tool is applied in a somewhat different way and FIG. 16 schematically shows a side view of a third embodiment of a bucket according to the invention in the form of a so called clamshell bucket with two sorting parts shown in a sorting position.

In the FIGS. 1 designates a bucket for e.g. excavating etc. arranged to be carried by means of a, not shown, machine arm 2, intermittently marked in FIG. 4 or the like for manaeuvring. The bucket comprises a bottom and back part 3 and opposing side parts 4, as shown in FIG. 1, 2 and 4. Said parts together form a load space 5 with an opening 6 with an edge part 8 connected to the bottom part 7 of the bottom and back part and running sideways in the bucket.

According to the invention said bottom and back part comprises an internal sorting part 9, FIG. 2, through which among other things liquid and comparatively finely distributed goods, e.g. sand and soil, can pass, as well as an external sealing part 10, which is swingable towards and from the sorting part between a first position, an open position, in which the sorting part is substantially exposed, and a second position, a closed position, in which the sealing part sealingly substantially connects to the sorting part.

11 designates a roof part, which bridges the side parts and, according to the shown, preferred embodiment, carries at least one, but preferably two hydraulic cylinders 12 for swinging the sealing part between said two positions. The roof part preferably also carries a fastening arrangement 10 for said arm or the corresponding.

According to a preferred embodiment the sorting part comprises a plurality of substantially rod shaped elements 4 running between the side parts and distributed along the bottom and back part for the formation of a sorting configuration. It is also preferred that further elements 15 are provided and running substantially perpendicular to the rod shaped elements and connecting them.

According to the embodiment shown, the sealing part at each of its two opposing sides comprises a flange part 16 turned to the sorting part and at least partly toothed, so that objects 17 as intermittently lined in FIG. 2, can be gripped and held between the sealing part and the sorting part.

Also according to the embodiment shown the sealing part, at its free edge 18, comprises at least one fixing means 19 with substantial tooth shaped section, FIG. 3, which fixing means is arranged to sealingly connect to the edge part 8 arranged to the side parts and the sorting part, which edge part is intended to be the active edge part when excavating etc. and preferably to be made of scraper steel or the corresponding. The fixing means are arranged to run along the edge part, preferably on a somewhat higher level than the edge part bottom side 8, whereby the fixing means, for good sealing, is sealed by means of sloping surface 19' turned to the edge part and fitted against a surface of the edge part elevating against the fixing means and having the corresponding inclination, FIG. 3. The inclination angle v is e.g. about 20–30°, preferably about 26°.

The fixing means are also arranged to fix various tools such as an asphalt cutter 20, FIG. 6, or a ripper element 21, having one or more digging teeth 22, FIG. 5, to the edge part by squeezing and where the respective tools comprise a fixing piece 23, arranged to be applied to the edge part and to be fixed by squeezing to the same in a suitable manner.

According to a further embodiment vibration means 24 are provided and connected to the sorting arrangement, e.g. via said roof part, as intermittently marked in FIG. 2, for promoting the sorting. To do this, devibrating parts, made of e.g. rubber or the like elastic material, are put into the fastening arrangement 13 for said arm or the corresponding in order to prevent vibrations to the sorting are transferred to the arm or the corresponding. At the fastening arrangement 13 according to FIGS. 7 and 8 is a gate 13', e g of substantially known kind, attached to the bucket by means of fastening ears 13" and two axles 13''', where parts 25 made of elastic material are provided and arranged between the respective axle and the axle fastening points 13'''' of the gate for devibration, as schematically shown in FIG. 7.

In the especially preferred embodiment shown in FIGS. 9–15 is said sorting part removably arranged and hereby arranged to be attached internally between the side parts 4. According to the embodiment shown the sorting part comprises two opposing frame elements 26, between which rod shaped elements 14 are running. For attachment two flange parts 28 are provided e.g. in the forward edge 27 of the sorting part arranged to be inserted and held under corresponding flange parts 28 of the edge part 8 running between the side parts and internal pins 29 arranged to be inserted in a notch 30 in said frame element.

24 designates vibration means, such as a motor with an excenter weight, arranged on the removable sorting part for vibrating the same. The sorting part is preferably arranged between the side parts with a substantial gap in order to allow the necessary movability and therewith efficient vibration.

In FIGS. 12–15 31 designates a combined ripper and asphalt cutting tool arranged to be helt by means of the bottom and back part in an asphalt cutting position, FIGS. 12 and 14, or a ripping position, FIGS. 13 and 15. The tool comprises two notches 32, 33 running in the width direction of the bucket, in which notches the edge part 8, FIGS. 12 and 13, or the free edge 18 of the sealing part, FIGS. 14 and 15, are intended to be inserted for fixing of the tool as should be obvious from the Figures, whereby the tool is arranged, by means of support surfaces, to be able to be put on an underlay in substantially said positions, so that gripping and application of the tool can be done without manual action.

The invention is applicable for buckets with a bottom and back part according to e.g. FIG. 1. The invention is also applicable for buckets of the clam shell type, FIG. 16, comprising two bottom and back parts arranged to be swung towards and from each other in order to grip goods in a hanging position. Hereby either one or both of the two buckets parts be arranged with an internal sorting part 9 and an external sealing part 10 in principally the same way as a bucket according to e.g. FIG. 1, whereby the sorting part may be fixed or removable in the way described earlier. In the embodiment shown in FIG. 16 the respective bottom and back parts are swingable by means of cylinders 12 towards and from the respective sorting part and the respective pair of such parts swingable towards and from each other by means of cylinders 12' for gripping by the bucket.

The function of the bucket according to the invention should to a substantial part have been made obvious above. In order to obtain a sorting configuration of the bucket, the sealing part is swung from the sorting part, whereby liquid and finely dispersed goods may pass from the load space through the sorting part. The sealing part is swung towards the sorting part in order to obtain a sealed bucket for ordinary use.

As should have been made obvious above the invention offers several alternative functions of a bucket by comparatively simple means. By means of a removable and, thus, exchangeable sorting part, parts for different goods size of passing goods may be arranged in the bucket.

Above, the invention has been described in association with exemplifying embodiments. Of course, further embodiments and minor changes and complements may be imagined without leaving the substantial inventive idea.

Thus, the sorting part may be designed to have a more distinct net configuration or as a disc shaped part provided with holes.

Thus, the invention should not be regarded as limited to the embodiments specified above but may be varied within the frame given by the attached claims.

What is claimed is:

1. A bucket assembly for mounting on a maneuvering arm comprising:

a sealing member;

transversely spaced side parts opposing said sealing member;

an edge part extending transversely between said side parts and being shaped and located to form an active edge for the bucket assembly;

a sorting part having a grid for sorting material within the bucket assembly and extending between said side parts;

said sealing member being swingable away from and toward said sorting part and said side parts between first and second positions, respectively;

said side parts, said sorting part and said sealing member in said second position thereof forming a sealed bucket defining a load space with an opening for receiving material;

said sealing member in said first position being spaced from said sorting part enabling and exposing said sorting part for sorting material within the load space and a second position overlying the sorting part to substantially seal the bucket assembly and load space precluding passage of material through the sorting part.

2. A bucket assembly according to claim 1 including a roof part connected to said side parts and carrying at least one hydraulic cylinder for swinging the sealing member between said positions.

3. A bucket according to claim 2 wherein said roof part carries an attachment for said arm.

4. A bucket according to claim 1 wherein said sorting part includes substantially rod-shaped elements extending between said side parts.

5. A bucket assembly according to claim 4 including further elements extending substantially perpendicular and connected to said rod-shaped elements to form a grid.

6. A bucket assembly according to claim 1 wherein the sealing member at each two opposite sides thereof includes a flange having teeth lying in opposition to the sorting part whereby objects may be gripped and held between the sealing member and the sorting part when the sealing member lies in said first position.

7. A bucket assembly according to claim 1 wherein the sealing member has a free edge including at least one fixing means having a substantially tooth-shaped cross-section for sealing against said side edge part in said second position of said sealing member.

8. A bucket according to claim 7 wherein a tool is secured to one of said free edge and said edge part.

9. A bucket assembly according to claim 1 wherein a combined scarfing and asphalt cutting tool is secured to said edge part of the bucket assembly, enabling the tool to take a scarfing position and an asphalt-cutting position, respectively.

10. A bucket assembly according to claim 1 including means connected to the sorting part for vibrating the sorting part to promote sorting.

11. A bucket assembly according to claim 10 wherein an attachment for the arm includes an elastic element for preventing transmission of vibrations to the arm.

12. A bucket assembly according to claim 1 wherein said side parts, sorting part and said edge part form an integral unit, said sealing member being pivotally connected to said unit for movement between said first and second positions.

13. A bucket assembly according to claim 1 wherein said side plates and said edge part form an integral unit, said sealing member being pivotally connected to said unit for pivotal movement between said first and second positions, said sorting part being releasably secured to said unit.

14. A bucket assembly according to claim 1 wherein the sealing member overlies solely a back side and underside of the sorting part.

* * * * *